United States Patent [19]

Mages et al.

[11] 4,352,222

[45] Oct. 5, 1982

[54] HINGE

[75] Inventors: Bernhard Mages, Dornbirn; Erich Röck, Höchst, both of Austria

[73] Assignee: Julius Blum Gesellschaft m. b. H., Höchst, Austria

[21] Appl. No.: 119,369

[22] Filed: Feb. 7, 1980

[30] Foreign Application Priority Data

Feb. 22, 1979 [AT] Austria ..... 1361/79
May 3, 1979 [AT] Austria ..... 3337/79

[51] Int. Cl.[3] ..... E05D 3/06

[52] U.S. Cl. ..... 16/287; 16/304; 16/321; 16/366

[58] Field of Search ..... 16/142, 145, 146, 180, 16/181, 182, 183, 163, 164, 287, 304, 321, 366

[56] References Cited

U.S. PATENT DOCUMENTS

| | | | |
|---|---|---|---|
| 3,564,643 | 2/1971 | Salice | 16/180 X |
| 3,568,241 | 3/1971 | Uffner | 16/180 X |
| 3,629,899 | 12/1971 | Deadrick | 16/180 X |
| 3,835,585 | 9/1974 | Anderson et al. | 16/142 X |
| 4,065,829 | 1/1978 | Lautenschläger | 16/163 X |
| 4,184,228 | 1/1980 | Lautenschläger et al. | 16/145 X |
| 4,226,001 | 10/1980 | Salice | 16/145 |
| 4,251,900 | 2/1981 | Lautenschläger | 16/145 |

FOREIGN PATENT DOCUMENTS

| | | | |
|---|---|---|---|
| 563886 | 9/1958 | Canada | 16/145 |
| 2337224 | 2/1975 | Fed. Rep. of Germany | 16/142 |
| 2750915 | 5/1979 | Fed. Rep. of Germany | 16/145 |
| 1077838 | 8/1967 | United Kingdom | 16/145 |

*Primary Examiner*—W. Carter Reynolds
*Attorney, Agent, or Firm*—Wenderoth, Lind & Ponack

[57] ABSTRACT

A hinge with a snap-in mechanism is activated by a spring. The spring is housed in a bush-like member pivotally mounted on a hinge axle of the hinge arm. There are two hinge links that connect the hinge arm with the hinge casing. The bush-like member presses on one hinge link when the hinge is in its closed position but rests mainly or completely on the hinge axle of the hinge link when the hinge is in its open position.

10 Claims, 9 Drawing Figures

HINGE

BACKGROUND OF THE INVENTION

1. Field of the Invention

The invention relates to a hinge having a catch mechanism, a hinge arm adapted to be fastened to a furniture side-wall and linked to a hinge casing or the like by means of two hinge links, the hinge casing or the like being adapted to be fixed to a door wing, one of the two hinge links being acted upon by a pressure spring, the pressure spring pressing against said hinge link by means of an intermediate member arranged between said hinge link and the pressure spring, said intermediate member being a bush-like member receiving the pressure spring.

2. Description of the Prior Art

Hinges of the above-mentioned type are widely used in modern furniture construction, particularly in the production of modern kitchen furniture. In most cases the catch mechanism in the hinge can replace a separate closing device on the door, e.g. a snapping device, and, thus, reduce the cost of the piece of furniture. Moreover, the catch mechanism prevents the door from remaining open unintentionally due to negligence, as it pulls the door into its final or closed position when the door wing and the closing plane are within a certain angle.

SUMMARY OF THE INVENTION

It is, therefore, the object of the present invention to improve hinges of the afore-mentioned type and to obtain a more secure functioning than with prior art hinges comprising a catch mechanism.

It is a further object of the invention to adapt the catch mechanism to be very compactly arranged in the hinge arm without being in the way of or interfering with the other parts of the hinge arm which are required for mounting the hinge arm, e.g. fastening screws and adjusting screws, and necessary for joint- and depth adjustments.

It is a further object of the invention to produce a hinge incurring a low cost of production.

According to the invention this is achieved by mounting the bush-like member on the hinge arm, in such a way that the member can pivot around its support resting with its free end against one of the hinge links as well as against the axle of such hinge link, whereby the bush-like member rests mainly or fully against the hinge link when the hinge is closed, and mainly or fully against the axle of the hinge link when the hinge is in its open position.

In an embodiment of the present invention the bush-like member has two pressure faces on its free end, faces which are inclined to each other.

In a further embodiment the bush-like member is mounted on a hinge axle of the hinge arm.

It is preferable that the bush-like member has at least one lateral pin which rests on a supporting flange formed on a hinge link, such supporting flange preferably having a V-shaped recess, the pin resting against the rim of the recess.

In another preferable embodiment the hinge axle is provided with a bearing bushing which is rotatable on the hinge axle. This bearing bushing can be made of plastics.

With the bushing a particularly easy and smooth change from the locking position to the "free" position of the parts of the spring mechanism is obtained.

BRIEF DESCRIPTION OF THE DRAWINGS

In the following embodiments of the present invention will be described in more detail with reference to the accompanying drawings, without being limited thereto, and wherein.

DESCRIPTION OF THE PREFERRED EMBODIMENTS

Figure 1:
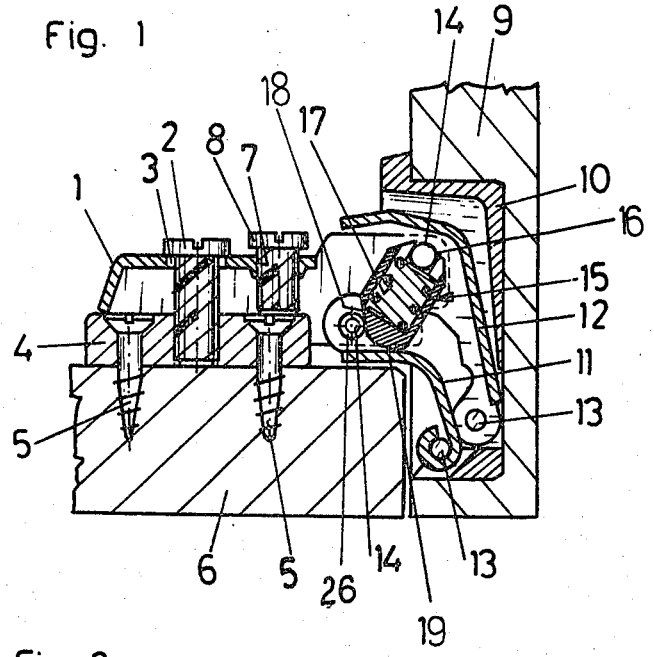
FIG. 1 is a schematic sectional view of a hinge in accordance with the present invention, shown in the closed position.

The hinge in accordance with the present invention comprises a hinge arm 1 fastened to a mounting plate 4 by means of a fastening screw 2, which extends through a slot 3 in the hinge arm 1. The mounting plate 4 is, according to the present embodiment, screwed to a furniture side-wall 6 by means of screws 5. Any other fastening means, e.g. dowels, could be used as well.

An adjusting screw 8 is mounted in a threaded bore 7 of the hinge arm 1. An adjustment of the hinge arm 1 and, thus of the hinge in the breadth of the direction of the door joint can be effected by means of said, adjusting screw 8 and fastening screw 2.

A hinge casing 10 is inserted into a door 9. The hinge casing 10 and the hinge arm 1 are linked by means of two hinge links 11, 12 which are mounted on bearing axles 13 in the hinge casing 10 and on bearing axles 14 on the hinge arm 1.

A bush-like member 15 is arranged between the two hinge links 11, 12 and the two hinge axles 14 of the hinge arm. In the embodiment in accordance with FIGS. 1 through 4, the bush-like member 15 is mounted by means of recesses 16 on that hinge axle 14 linking the hinge link 12 and the hinge arm 1.

Figure 2:
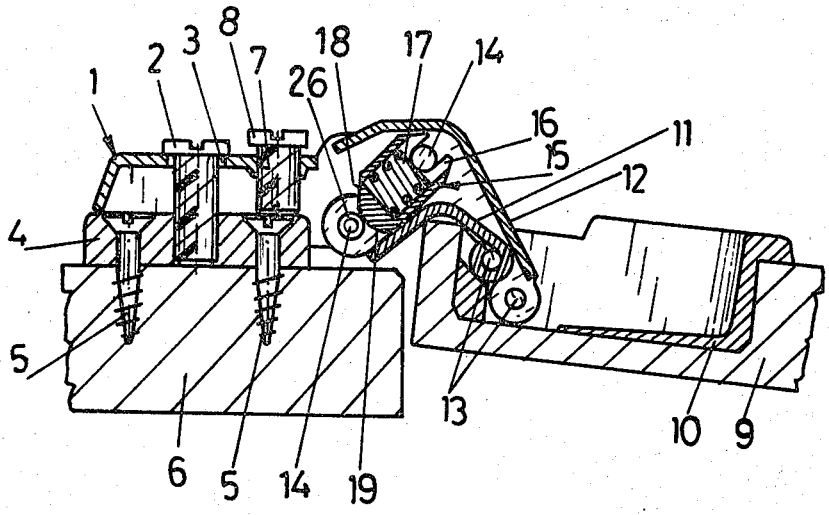
FIG. 2 is the same sectional view as FIG. 1, with the hinge shown open.
Figure 4:
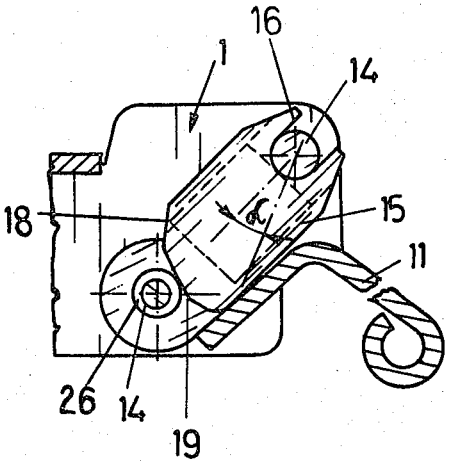
FIG. 4 is the same view as FIG. 3, but with the door shown open.

A coil spring 17 is provided in the bush-like member 15, and coil spring 17 rests against and is compressed between bush-like member 15 and hinge axle 14. The bush-like member 15 (FIGS. 1–4) has two pressure faces 18, 19 at its free end, pressure face 18 being planar, and pressure face 19 being curved. As can be seen in FIGS. 2 and 4, the bush-like member 15, when the door is open, fully rests against that hinge axle 14 which links the hinge link 11 and the hinge arm 1. Very little or no pressure at all is exerted on the hinge link 11.

When the door 9 is closed (FIG. 1, FIG. 3), however, the bush-like member 15 is directly pressed against the hinge link 11 by the force of the spring 17, and thus tends to hold the hinge link 11 in the closed position.

Figure 3:
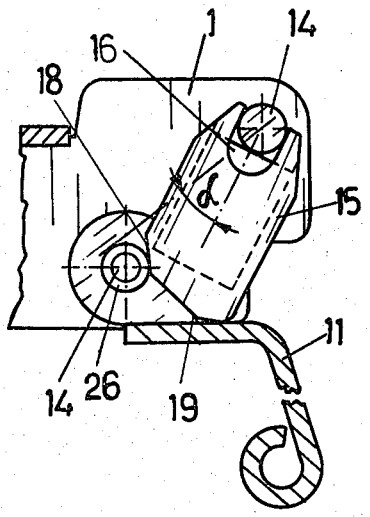
FIG. 3 is a schematic view of the closing mechanism, when the door is closed.
Figure 3A:
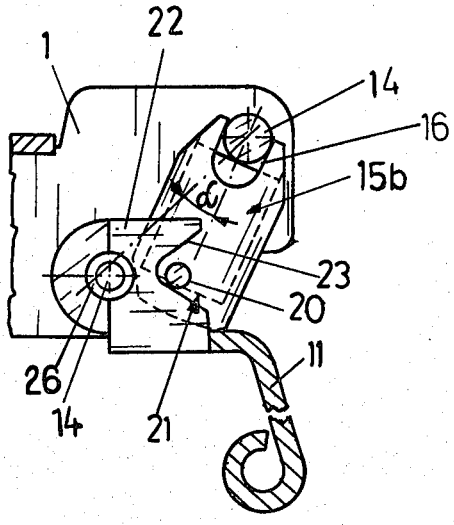
FIG. 3*a* is the same view as FIG. 3, but of a variant of the closing mechanism.
Figure 4A:
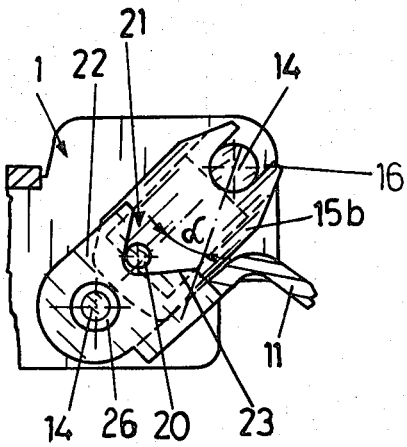
FIG. 4*a* is the same view as FIG. 3*a*, but with the door shown open.

The same effect is obtained in the embodiment in accordance with FIGS. 3*a* and 4*a*. In this embodiment the bush-like member 15*b* is provided with a lateral pin 20 which extends into a V-shaped recess 21 in a flange 22 molded to the hinge link 11. The lateral pin 20 is thereby guided on an edge or rim 23 of the recess 21. When the door 9 is in the open position, the bush-like member 15*b* and the lateral pin 20 are in the position illustrated in FIG. 4*a*, and the forces of the pressure spring 17 act radially on that hinge axle 14 which links hinge link 11 and the hinge arm 1. Consequently, no torque is exerted on the hinge link 11.

When the hinge is closed, the bush-like member 15*b* is in the position illustrated in FIG. 3*a*, i.e. the spring force is exerted on the hinge link 11.

Figure 5:
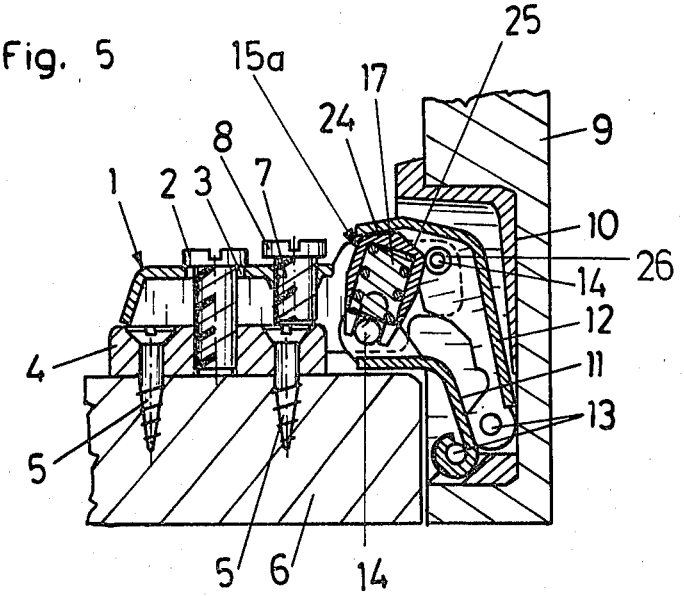
FIG. 5 is a sectional view similar to FIG. 1 of a further embodiment of the invention.
Figure 6:
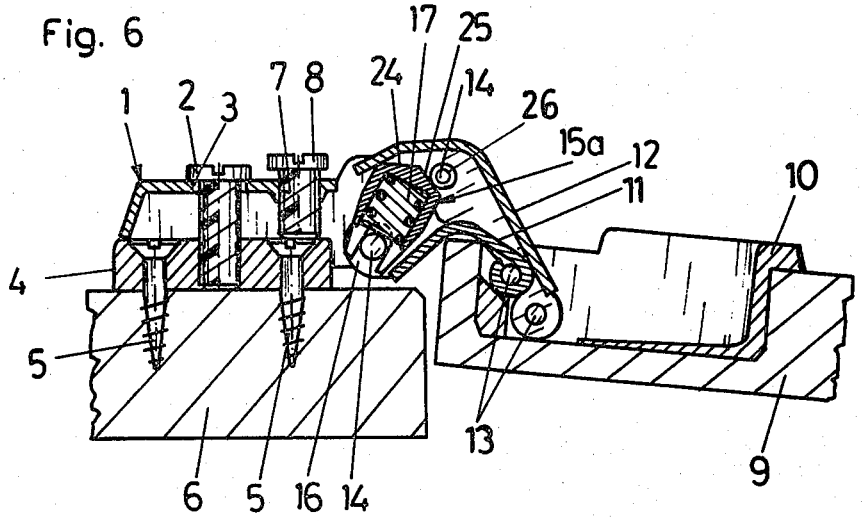
FIG. 6 is a sectional view similar to FIG. 5, but in the open position of the hinge.
Figure 7:
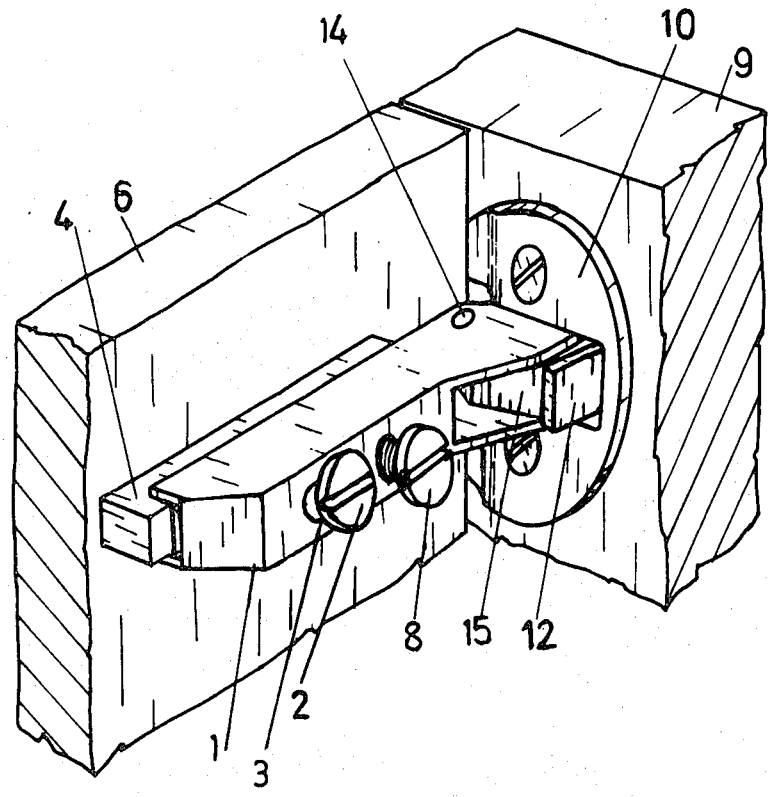
FIG. 7 is a perspective view of a hinge.

In the embodiment in accordance with FIGS. 5 and 6, a bush-like member 15*a* is mounted on the hinge axle 14 linking the hinge arm 1 and the hinge link 11, i.e. the inner hinge link. The free end of the bush-like member 15*a* presses with pressure faces 24, 25 on the hinge link 12 and on that hinge axle 14, which links the hinge link 12, i.e. the outer hinge link, and the hinge arm 1.

The hinge link 12 on which the bush-like member 15*a* acts under the pressure of the spring 17 is a two-arm lever. The bush-like member 15*a* presses against the free lever arm, i.e. against the lever arm, of hinge link 12 which is not linked to the hinge casing 10. If, in the open position as well as in the closed position of the hinge, the bush-like member does not exclusively exert pressure either on the hinge link 12 or on the hinge axle 14 linking hinge link 12 and the hinge arm 1, either a major part of the spring force is, correspondingly to the position of the hinge, transmitted to the hinge link 12 (FIG. 5), whereby a closing pressure is exerted on hinge link 12, or a major part of the spring power is exerted on the hinge axle 14 (FIG. 6) so that the spring pressure being exerted on the hinge link 12 can be neglected.

In order to obtain an easier change of the bush-like member 15 or 15*a* or 15*b* from the closed position into the open position a rotatable bearing bushing 26 is arranged on the hinge axle 14 being acted upon by the bush-like member 15 or 15*a* or 15*b*.

The rotatable bearing bushing 26 serves as a bearing ring and rotates freely on the hinge axle 14 and substantially reduces the friction between the bush-like member 15 15*a* or 15*b* and the hinge axle 14.

The bearing bushing 26 can be made of metal or plastics.

What is claimed is:

1. A hinge comprising:

a hinge arm adapted to be mounted on an article of furniture, said hinge arm including a pair of hinge axles;

a hinge casing adapted to be mounted on a door of the article of furniture, said hinge casing including a pair of hinge axles;

a pair of hinge links pivotally mounted to said hinge axles of said hinge arm and to said hinge axles of said hinge casing, thereby mounting said hinge casing and the door to be pivotable with respect to said hinge arm and the article of furniture between open and closed positions of said hinge casing and the door;

a bush-like member mounted about a first end thereof for pivotal movement; and spring means, operating on said member, for urging a second end of said member in directions to primarily abut with one of said hinge links when said hinge casing is in said closed position and to primarily abut one said hinge axle of said one hinge link when said hinge casing is in said open position.

2. A hinge as claimed in claim 1, wherein said one hinge axle comprises that hinge axle connecting said one hinge link to said hinge arm.

3. A hinge as claimed in claim 2, wherein said first end of said member is mounted for said pivotal movement with respect to that said hinge axle connecting the other said hinge link to said hinge arm.

4. A hinge as claimed in claim 3, wherein said member has therein a recess, said spring means being received within said recess and compressed between said member and that said hinge axle connecting said other hinge link to said hinge arm.

5. A hinge as claimed in claim 1, wherein said second end of said member has two pressure faces inclined to each other.

6. A hinge as claimed in claim 5, wherein one said face is planar and the other said face is curved.

7. A hinge as claimed in claim 1, wherein said one hinge axle has rotatably mounted thereon a bearing bushing.

8. A hinge as claimed in claim 7, wherein said bearing bushing as formed of a plastic material.

9. A hinge as claimed in claim 1, wherein said one hinge link includes a supporting flange, and said member has thereon a lateral pin urged by said spring means against said supporting flange.

10. A hinge as claimed in claim 9, wherein said supporting flange has therein a generally V-shaped recess, and said lateral pin abuts against the edge of said recess.

* * * * *